US009265114B2

(12) United States Patent
Palmer et al.

(10) Patent No.: US 9,265,114 B2
(45) Date of Patent: Feb. 16, 2016

(54) DRIVER CIRCUIT FOR SOLID STATE LIGHT SOURCES

(75) Inventors: Fred Palmer, Danvers, MA (US); Kerry Denvir, Cambridge, MA (US); Steven Allen, Mason, OH (US)

(73) Assignee: OSRAM SYLVANIA INC., Wilmington, MA (US)

( * ) Notice: Subject to any disclaimer, the term of this patent is extended or adjusted under 35 U.S.C. 154(b) by 839 days.

(21) Appl. No.: 13/471,650

(22) Filed: May 15, 2012

(65) Prior Publication Data

US 2013/0307422 A1 Nov. 21, 2013

(51) Int. Cl.
*H05B 37/02* (2006.01)
*H05B 33/08* (2006.01)

(52) U.S. Cl.
CPC ..... *H05B 33/0854* (2013.01); *H05B 33/089* (2013.01); *H05B 33/0857* (2013.01); *H05B 33/0866* (2013.01)

(58) Field of Classification Search
CPC ..... H05B 33/0854; H05B 33/089; H05B 33/0866; H05B 33/0857; H05B 33/0839; H05B 33/086; H05B 37/02
See application file for complete search history.

(56) References Cited

U.S. PATENT DOCUMENTS

| | | | | |
|---|---|---|---|---|
| 8,248,398 | B2 * | 8/2012 | Cho et al. | 345/211 |
| 2011/0031889 | A1 * | 2/2011 | Shim | 315/158 |
| 2011/0068702 | A1 | 3/2011 | Van De Ven et al. | |
| 2011/0266961 | A1 * | 11/2011 | Tsai | 315/185 R |
| 2011/0273102 | A1 * | 11/2011 | van de Ven et al. | H05B 33/0809 315/193 |

OTHER PUBLICATIONS

M. Burchielli, International Search Report and Written Opinion of the International Searching Authority for PCT/US2013/039368, Aug. 12, 2013, pp. 1-9, European Patent Office, Rijswijk, The Netherlands.

* cited by examiner

*Primary Examiner* — Tuyet Vo
*Assistant Examiner* — Henry Luong
(74) *Attorney, Agent, or Firm* — Shaun P. Montana

(57) ABSTRACT

A driver circuit for a light source including one or more solid state light sources, a luminaire including the same, and a method of so driving the solid state light sources are provided. The driver circuit includes a rectifier circuit that receives an alternating current (AC) input voltage and provides a rectified AC voltage. The driver circuit also includes a switching converter circuit coupled to the light source. The switching converter circuit provides a direct current (DC) output to the light source in response to the rectified AC voltage. The driver circuit also includes a mixing circuit, coupled to the light source, to switch current through at least one solid state light source of the light source in response to each of a plurality of consecutive half-waves of the rectified AC voltage.

12 Claims, 8 Drawing Sheets

DRIVER CIRCUIT FOR SOLID STATE LIGHT SOURCES

GOVERNMENT LICENSE RIGHTS

This invention was made with government support under contract number DE-EE0000611 awarded by the United States Department of Energy. The government has certain rights in the invention.

TECHNICAL FIELD

The present invention relates to lighting, and more specifically, to electronic drivers for solid state light sources.

BACKGROUND

The development of high-brightness solid state light sources has led to use of such devices in various lighting fixtures. Typically, a solid state light source is a direct current (DC) device, and so a driver circuit (also referred to simply as a "driver" or "power supply") is typically required to operate the solid state light source on alternating current (AC) power (e.g., mainline 120V/60 Hz input AC power, or input from a typical dimmer switch). The driver typically converts an AC input to a stable DC voltage through use of a rectifier and a switching converter.

A number of switching converter configurations are well-known in the art, such as buck converters, boost converters, buck-boost converters, and the like, which are generally categorized as switching regulators. These devices include a switch, e.g. a transistor, which is selectively operated to allow energy to be stored in an energy storage device, e.g. an inductor, and then transferred to one or more filter capacitors. The filter capacitor(s) provide a relatively smooth DC output voltage to the load and provide essentially continuous energy to the load between energy storage cycles.

Another known type of switching converter includes a known transformer-based switching regulator, such as a "flyback" converter. In a transformer-based switching regulator, the primary side of the transformer is typically coupled to the output of the rectifier. A regulated DC output voltage is provided at the secondary side of the transformer, which is electrically isolated from the primary side of the transformer.

Further, to provide improved power factor, some driver circuits include a power factor correction circuit that may, for example, control operation of the switch in a switching converter. A power factor correction circuit typically monitors the rectified AC voltage, the current drawn by the load, and the output voltage to the load, and provides an output control signal to switch current to the load having a waveform that substantially matches and is in phase with the rectified AC voltage.

SUMMARY

Conventional driver circuits for solid state light sources, such as are described above, suffer from a variety of issues. One issue with a driver circuit, particularly for solid state light sources designed to fit into lighting fixtures designed for conventional light sources, is the limited space due to the solid state light sources needing to occupy the same or similar form factor as the conventional light source. Lighting fixtures designed for conventional light sources generally adhere to one of a number of standards with regard to lamp size, base size, method of attachment, etc. For example, a lighting fixture designed for one or more MR16 lamps provides a relatively small form factor within which the driver circuit must fit, along with other components (i.e., solid state light sources, optics, thermal management, etc.). It may be difficult to fit a driver circuit in this space while meeting other design constraints, such as but not limited to high power factor and high efficacy, i.e. lumens-per-watt (LPW).

These issues are exacerbated in applications where it is desired to drive solid state light sources that generate different colors of light so as to achieve a desired mixing of the colors to create white/substantially white light (i.e., color mixing). In such applications, different types and different numbers of solid state light sources of different colors may have different current draw requirements. One approach to achieving color mixing is to drive differently colored solid state light sources using a separate driver circuit for each distinct color. This approach, however, requires increased space and power, which may not be practical in small form factor applications. Another approach is to use wavelength-converted solid state light sources, which involves use of a wavelength converting material, such as one or more phosphors, on or adjacent to the solid state light sources to provide a desired color output. Wavelength-converted solid state light sources, however, may exhibit lower efficacy than solid state light sources that are not wavelength-converted.

Embodiments of the present invention provide a driver circuit that overcomes these and other limitations. Embodiments allow for the mixing of light from different solid state light sources within a single device (e.g., light engine, lamp, etc.) using an AC input source as a timer. A rectified version of the AC input is provided to a mixing circuit that switches one or more solid state light sources between an "off" state and an "on" state in response to the rectified version of the AC input. In some embodiments, this switching occurs while one or more other solid state light sources remain in an "on" state. The light from the switched solid state light sources and the solid state light sources that remain on mixes at a distance from the driver circuit. In embodiments where the solid state light sources emit different colors of light, a desired color mixing may be achieved by the selection of the number, color and/or arrangement of the solid state light sources. Advantageously, embodiments may be implemented in a small size while avoiding the need for separate controllers associated with each color of solid state light source. Also, high efficacy may be achieved by using solid state light sources that are not wavelength-converted, although of course, wavelength-converted solid state light sources may be used.

In an embodiment, there is provided a driver circuit. The driver circuit includes: a rectifier circuit configured to receive an alternating current (AC) input voltage and to provide a rectified AC voltage; a switching converter circuit coupled to a light source including one or more solid state light sources, the switching converter circuit configured to provide a direct current (DC) output to the light source in response to the rectified AC voltage; and a mixing circuit coupled to the light source to switch current through at least one solid state light source of the light source in response to each of a plurality of consecutive half-waves of the rectified AC voltage.

In a related embodiment, the mixing circuit may include: a switch circuit having a conductive state, wherein the switch circuit may be coupled to the at least one solid state light source; and a controller circuit configured to provide a controller output to change the conductive state of the switch circuit in response to each of the plurality of half-waves of the rectified AC voltage.

In a further related embodiment, the mixing circuit may further include: a voltage reference circuit configured to establish a reference voltage; wherein the controller circuit may be configured to provide the controller output in response to the reference voltage and the rectified AC voltage. In a further related embodiment, the voltage reference circuit may include a voltage divider comprising a thermistor that exhibits a resistance that varies with a temperature of the at least one solid state light source. In another further related embodiment, the controller circuit may include an operational amplifier having an output coupled to the switch circuit, wherein a first input of the operational amplifier may be coupled to the rectified AC voltage and a second input of the operational amplifier may be coupled to the reference voltage. In yet another further related embodiment, the mixing circuit may include a synchronous oscillator circuit configured to provide an output at a frequency of the plurality of half-waves of the rectified AC voltage, and the controller circuit may include an operational amplifier having an output coupled to the switch circuit, a first input of the operational amplifier coupled to the output of the synchronous oscillator circuit, and a second input of the operational amplifier coupled to the reference voltage.

In yet another related embodiment, the switching converter circuit may include a control input and the controller circuit may be configured to provide a control output to the control input of the switching converter circuit, the control output to modify the DC output when the current is switched through the at least one solid state light source.

In still another related embodiment, the light source may include at least one additional solid state light source configured to remain in a light-emitting state while the mixing circuit switches current through the at least one solid state light source. In a further related embodiment, the light source may include a first set of solid state light sources and a second set of solid state light sources, the first set of solid state light sources may include the at least one solid state light source, and the second set of solid state light sources may include the at least one additional solid state light source, the second set of solid state light sources being coupled in parallel with a series combination of the first set of solid state light sources and the switch circuit. In another further related embodiment, the light source may include a first set of solid state light sources and a second set of solid state light sources, the first set of solid state light sources may include the at least one solid state light source, and the second set of solid state light sources may include the at least one additional solid state light source, the second set of solid state light sources being coupled in series with a parallel combination of the first set of solid state light sources and the switch circuit.

In another embodiment, there is provided a luminaire. The luminaire includes: a housing; a light source including one or more solid state light sources disposed within the housing; and a driver circuit disposed within the housing, the driver circuit including: a rectifier circuit configured to receive an alternating current (AC) input voltage and to provide a rectified AC voltage; a switching converter circuit coupled to the light source including one or more solid state light sources, the switching converter circuit configured to provide a direct current (DC) output to the light source in response to the rectified AC voltage; and a mixing circuit coupled to the light source to switch current through at least one solid state light source of the light source in response to each of a plurality of consecutive half-waves of the rectified AC voltage.

In a related embodiment, the mixing circuit may include: a switch circuit having a conductive state, wherein the switch circuit may be coupled to the at least one solid state light source; and a controller circuit configured to provide a controller output to change the conductive state of the switch circuit in response to each of the plurality of half-waves of the rectified AC voltage. In a further related embodiment, the mixing circuit may further include: a voltage reference circuit configured to establish a reference voltage; wherein the controller circuit may be configured to provide the controller output in response to the reference voltage and the rectified AC voltage. In a further related embodiment, the controller circuit may include an operational amplifier having an output coupled to the switch circuit, wherein a first input of the operational amplifier may be coupled to the rectified AC voltage and a second input of the operational amplifier may be coupled to the reference voltage. In another further related embodiment, the mixing circuit may include a synchronous oscillator circuit configured to provide an output at a frequency of the plurality of half-waves of the rectified AC voltage, and the controller circuit may include an operational amplifier having an output coupled to the switch circuit, a first input of the operational amplifier coupled to the output of the synchronous oscillator circuit, and a second input of the operational amplifier coupled to the reference voltage.

In yet another related embodiment, the light source may include at least one additional solid state light source configured to remain in a light-emitting state while the mixing circuit switches current through the at least one solid state light source. In a further related embodiment, the light source may include a first set of solid state light sources and a second set of solid state light sources, the first set of solid state light sources may include the at least one solid state light source, and the second set of solid state light sources may include the at least one additional solid state light source, the second set of solid state light sources being coupled in parallel with a series combination of the first set of solid state light sources and the switch circuit. In another further related embodiment, the light source may include a first set of solid state light sources and a second set of solid state light sources, the first set of solid state light sources may include the at least one solid state light source, and the second set of solid state light sources may include the at least one additional solid state light source, the second set of solid state light sources being coupled in series with a parallel combination of the first set of solid state light sources and the switch circuit.

In another embodiment, there is provided a method of color mixing in a light source including one or more solid state light sources. The method includes: providing at least one solid state light source of a first color and at least one additional solid state light source of a second color different from the first color in the light source; receiving an alternating current (AC) input signal; rectifying the AC input signal to provide a rectified AC voltage; providing a direct current (DC) output to the light source in response to the rectified AC voltage; and switching current through the at least one solid state light source of the first color in response to each of a plurality of consecutive half-waves of the rectified AC voltage.

In a related embodiment, the method may further include: maintaining the at least one additional solid state light source of the second color in a light-emitting state while switching current through the at least one solid state light source of the first color.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

As used throughout, the term "solid state light source" refers to one or more light emitting diodes (LEDs), organic light emitting diodes (OLEDs), polymer light emitting diodes (PLEDs), or any other semiconductor-based device capable of emitting light, and/or combinations thereof. As used throughout, the term "color" generally refers to a property of radiation that is perceivable by an observer (though this usage is not intended to limit the scope of this term). Accordingly, the term "different colors" implies two different spectra with different dominant wavelengths and/or bandwidths. In addition, "color" may be used to refer to white and non-white light. Use of a specific color such as "red", "green", etc. to describe a solid state light source or sources, or the light emitted thereby, refers to a specific range of dominant wavelengths associated with the specific color. In particular, the terms "red" and "amber" when used to describe a solid state light source or sources, or the light emitted thereby, means the solid state light source(s) emits light with a dominant wavelength between 610 nm and 750 nm. The term "green" when used to describe a solid state light source or sources, or the light emitted thereby, means the solid state light source(s) emits light with a dominant wavelength between 495 nm and 570 nm. The term "mint" when used to describe a solid state light source or sources, or the light emitted thereby, means the solid state light source(s) emit white light and/or substantially white light that has a greenish element to the white light, such that it is above the Planckian curve and is in and/or substantially in the green color space of the 1931 CIE chromaticity diagram. As used throughout, the term "luminaire" includes, without limitation, a device in the shape of a conventional light source (e.g., a light bulb, a lamp, a retrofit light bulb), a device including a housing that at least partially surrounds a light source, and a device (i.e., a fixture) capable of including any of the aforementioned or any other light source(s), and/or combinations thereof.

Figure 1:
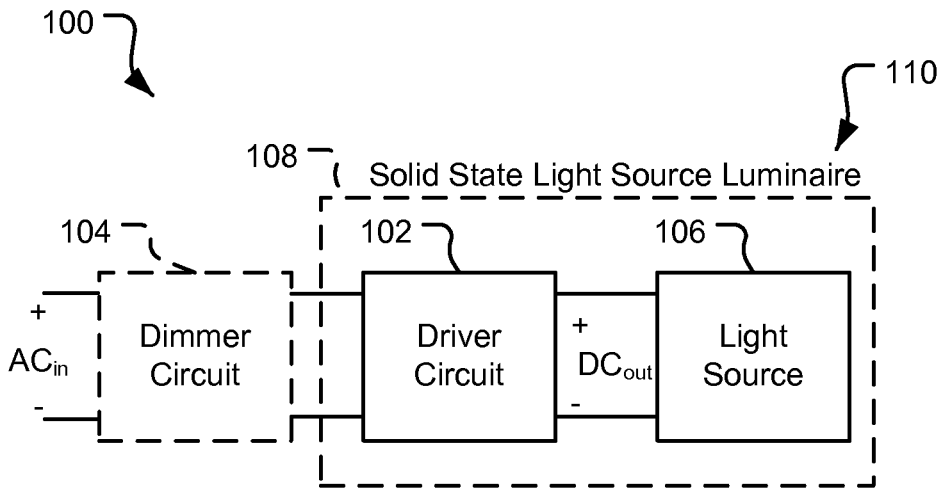
FIG. 1 is a block diagram of a system including a driver circuit according to embodiments disclosed herein.

FIG. 1 shows a system 100 including a driver circuit 102 according to embodiments described herein. The driver circuit 102 receives an alternating current (AC) input $AC_{in}$. In some embodiments, the AC input $AC_{in}$ may be provided directly from a 120VAC/60 Hz line source. It is to be understood, however, that embodiments may operate from other AC sources, such as a 220-240 VAC at 50-60 Hz. The AC input $AC_{in}$ may be provided either directly or through any known dimmer circuit 104, and provides a regulated direct current (DC) output voltage $DC_{out}$ to drive a light source 106 that includes one or more solid state light sources. The light source 106 may have any known configuration, such as but not limited a configuration that allows it to occupy a space, such as but not limited to a space occupied by an MR16 lamp. The one or more solid state light sources within the light source 106 may be sub-divided into different sets of solid state light sources that are interconnected in series and/or parallel configurations. The driver circuit 102 converts the AC input $AC_{in}$ to a regulated DC output voltage $DC_{out}$ while maintaining a high power factor, low total harmonic distortion (THD), high efficiency, and fitting in the space needed. The driver circuit 102 and the light source 106 may thus be provided within a housing 108 of a luminaire 110, as shown in FIG. 1.

Figure 2:
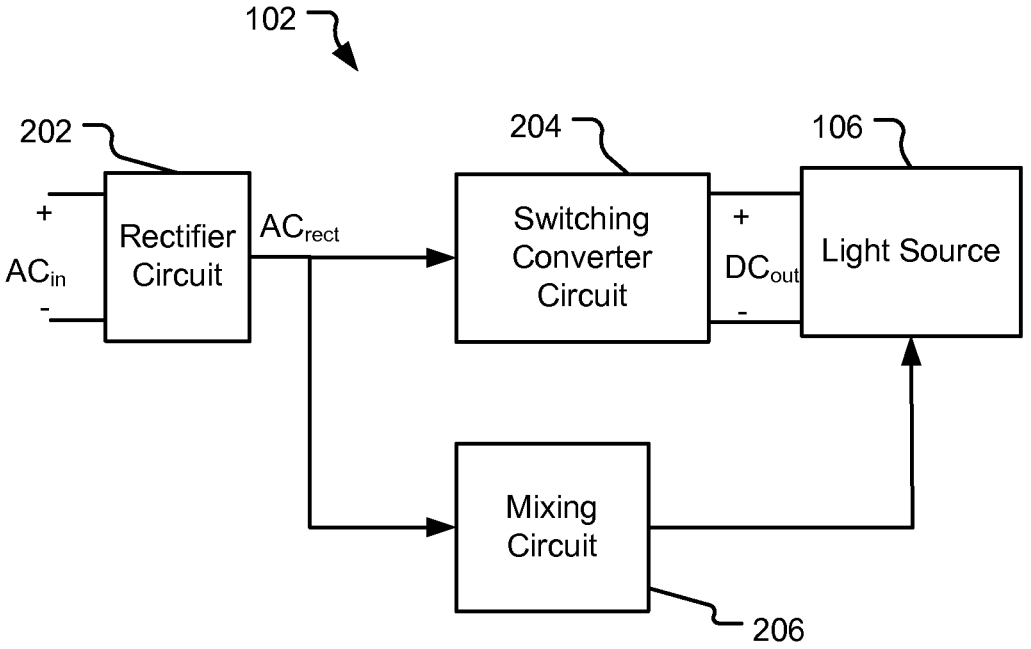
FIG. 2 is a block diagram of the driver circuit shown in FIG. 1 coupled to the light source shown in FIG. 1 according to embodiments disclosed herein.

FIG. 2 is a block diagram that conceptually illustrates the functionality of the driver circuit 102 shown in FIG. 1. As shown in FIG. 2, the driver circuit 102 includes a rectifier circuit 202, a switching converter circuit 204, and a mixing circuit 206. The regulated DC output voltage $DC_{out}$ of the switching converter circuit 204 is coupled to the light source 106 to drive the one or more solid state light sources in the light source 106. In general, the AC input $AC_{in}$ is coupled to the rectifier circuit 202, either directly or through a dimmer circuit 104 (as shown in FIG. 1). The rectifier circuit 202 is configured to rectify the AC input $AC_{in}$ to provide a full-wave rectified output voltage $AC_{rect}$. A variety of rectifier circuit configurations are well-known in the art. In some embodiments, for example, the rectifier circuit 202 may include a known diode bridge rectifier or a known H-bridge rectifier. The output of the rectifier circuit 202 is coupled to the light source 106 through the switching converter circuit 204. The switching converter circuit 204 may include any known switching regulator configuration, such as but not limited to a buck, boost, buck-boost, or flyback regulator, along with a known controller to control the switch within the switching converter circuit 204. In embodiments wherein the switching regulator configuration is a buck converter, for example, the controller may be a model number TPS40050 controller presently available from Texas Instruments Corporation of Dallas, Tex., USA. The switching converter circuit 204 may also include a known power factor correction (PFC) circuit configured to provide an output to the controller, e.g. in response to a signal representative of the output of the rectifier circuit 202 and a feedback signal representative of the current through the light source 106.

The mixing circuit 206 switches current through one or more solid state light sources in the light source 106 to thereby change the state of such solid state light sources from a non-light-emitting ("off") state to a light-emitting ("on") state in response to each of a plurality of consecutive half-waves of the rectified output voltage $AC_{rect}$. The driver circuit 102 thus uses the rectified output voltage $AC_{rect}$ of the rectifier circuit 202 as a timer for switching between the "on" and "off" state of one or more solid state light sources. For example, in embodiments where the AC input $AC_{in}$ is a 60 Hz signal that is full-wave rectified by the rectifier circuit 202 to achieve a rectified output voltage $AC_{rect}$ with 120 half-waves/second, the mixing circuit 206 may switch one or more solid state light sources in the light source 106 from an "off" state to an "on" state with each half-wave of the rectified output voltage $AC_{rect}$, i.e. 120 times/second.

In some embodiments, the light source 106 may include at least one additional solid state light sources that is configured to remain in the light-emitting ("on") state while the mixing circuit 206 switches current through one or more other solid state light sources of the light source 106. The light source 106 may be configured such that the variation in the "on" and "off" states of the solid state light sources therein, in response to the output of the mixing circuit 206, e.g. in combination with the light output from the solid state light sources that remain in an "on" state, establishes a predetermined mixing of the outputs of the solid state light sources. For example, in embodiments where the solid state light sources in the light source 106 are of different colors, the mixing of the outputs of the solid state light sources may establish a desired color mixing through combination of the light output from the solid state light sources at a distance therefrom.

Advantageously, providing color mixing in response to a signal that varies according a timing established by the variations in the rectified output voltage $AC_{rect}$ allows for a compact configuration of the driver circuit 102 that may be used in, for example, small form factor lamp assemblies, such as but not limited to an MR16 lamp, and avoids the need for separate driver circuits for each color of solid state light source. In addition, since color mixing may be achieved in a compact configuration, use of lower efficacy wavelength-converted LEDs may be avoided if desired.

Figure 3:
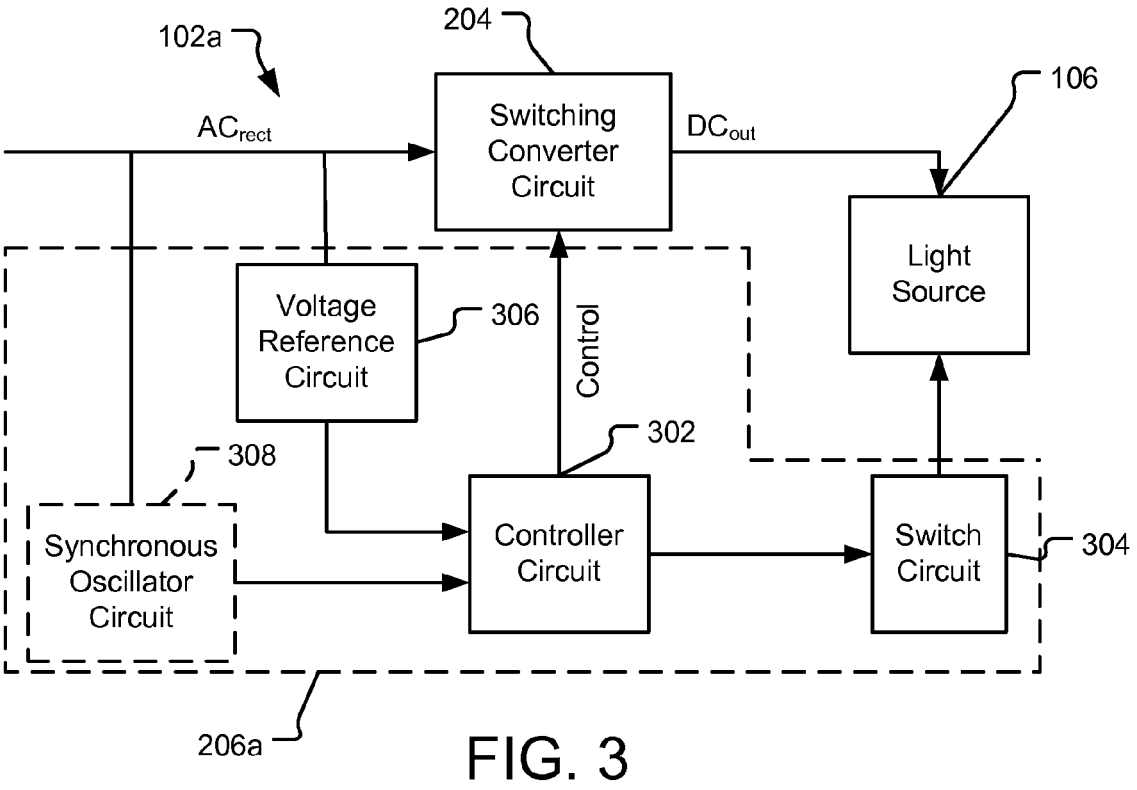
FIG. 3 is another block diagram of the driver circuit shown in FIG. 1 coupled to the light source shown in FIG. 1 according to embodiments disclosed herein.

The mixing circuit 206 shown in FIG. 2 may be provided in a variety of configurations. FIG. 3 illustrates a driver circuit 102*a* including a mixing circuit 206*a*, the switching converter circuit 204 shown in FIG. 2, and the light source 106. The mixing circuit 206*a* includes a controller circuit 302, a switch circuit 304, a voltage reference circuit 306, and an optional synchronous oscillator circuit 308.

The controller circuit 302 controls a conducting state of the switch circuit 304 in response to an output of the voltage reference circuit 306 and the rectified output voltage $AC_{rect}$ directly. In embodiments including the synchronous oscillator circuit 308, which is configured to vary with the rectified output voltage $AC_{rect}$, the controller circuit 302 controls the conducting state of the switch circuit 304 in response to the output of the synchronous oscillator circuit 308. The switch circuit 304 may be any component or group of components having a conducting or "closed" state, and a non-conducting or "open" state. In some embodiments, for example, the switch circuit 304 includes a transistor.

Figure 4:
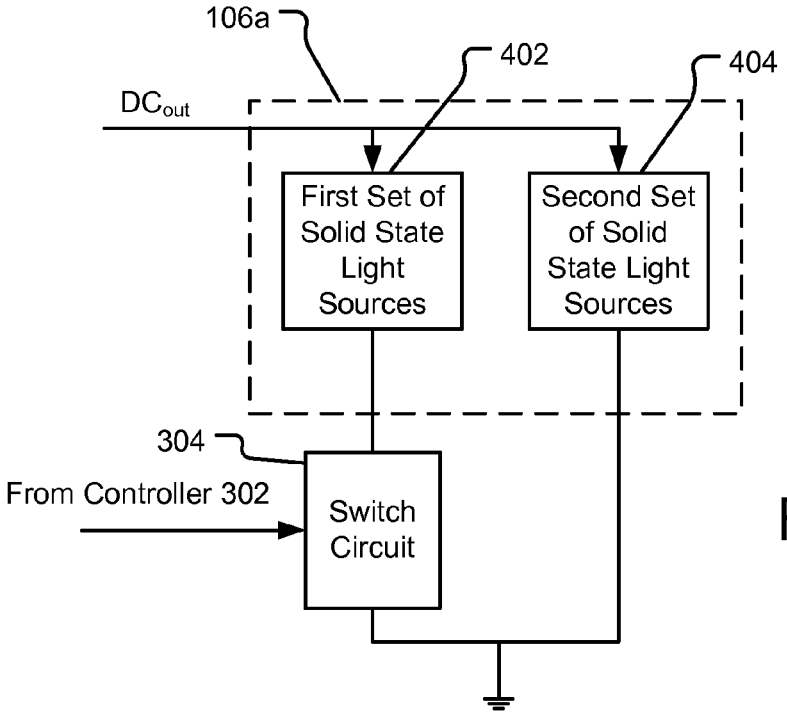
FIG. 4 is a block diagram of a light source including one or more solid state light sources according to embodiments disclosed herein.

The light source 106 may be provided in a variety of configurations such that the conducting state of the switch circuit 304 controls current flow through one or more solid state light sources to switch those solid state light sources between the "on" and "off" state, e.g., while one or more other solid state light sources remain in an "on" state. FIG. 4 shows a light source including one or more solid state light sources 106*a* that includes a first set of solid state light sources 402 and a second set of solid state light sources 404. As used herein, a "set" of solid state light sources may include zero, one, or more than one solid state light sources coupled in series, parallel, parallel combinations of series-connected solid state light sources, series combinations of parallel-connected solid state light sources, and/or combinations thereof. The operating characteristics and number of solid state light sources in the first set of solid state light sources 402 may be, and in some embodiments is, different from the operating characteristics and number of solid state light sources in the second set of solid state light sources 404. Though two sets of solid state light sources are shown, any number, i.e. one or more, of sets of solid state light sources may be provided.

In some embodiments, the first set of solid state light sources 402 may include one or more solid state light sources that emit light having a first color, either directly or through wavelength-conversion, and the second set of solid state light sources 404 may include one or more solid state light sources that emit light having a second color, either directly or through a wavelength-conversion, that is a different color from the first color. The solid state light sources within each of the respective sets of solid state light sources 402, 404 may be all the same color or may be different colors. The colors of the solid state light sources in the first 402 and second 404 sets may be selected to achieve a desired color mixing with opening and closing of the switch circuit 304 in response to the output of the controller circuit 302. In some embodiments, for example, the solid state light sources in the first set 402 may include one or more solid state light sources emitting a red or amber color, and the solid state light sources in the second set 404 may include one or more solid state light sources emitting a green or mint color.

In FIG. 4, the first set of solid state light sources 402 is coupled in series with the switch circuit 304. The series combination of the first set of solid state light sources 402 and the switch circuit 304 is coupled in parallel with the second set of solid state light sources 404. When the switch circuit 304 is closed, current flows through the first set of solid state light sources 402 to cause light output from the solid state light sources, and when the switch circuit 304 is open, any current flow through the first set of solid state light sources 402 is insufficient to cause light output from the solid state light sources therein. When the first set of solid state light sources 402 has a similar drive voltage to the second set of solid state light sources 404, current flows through the second set of solid state light sources 404 regardless of the state of the switch circuit 304. When the drive voltage of the first set of solid state light sources 402 is lower than the drive voltage to the second set of solid state light sources 404, current may flow through the first set of solid state light sources 402 when the switch circuit 304 is closed, but current through the second set of solid state light sources 404 may be insufficient to cause illumination of the solid state light sources therein. When the switch circuit 304 (and/or the switch therein) is opened in such a case, current is forced through the second set of solid state light sources 404.

Figure 5:
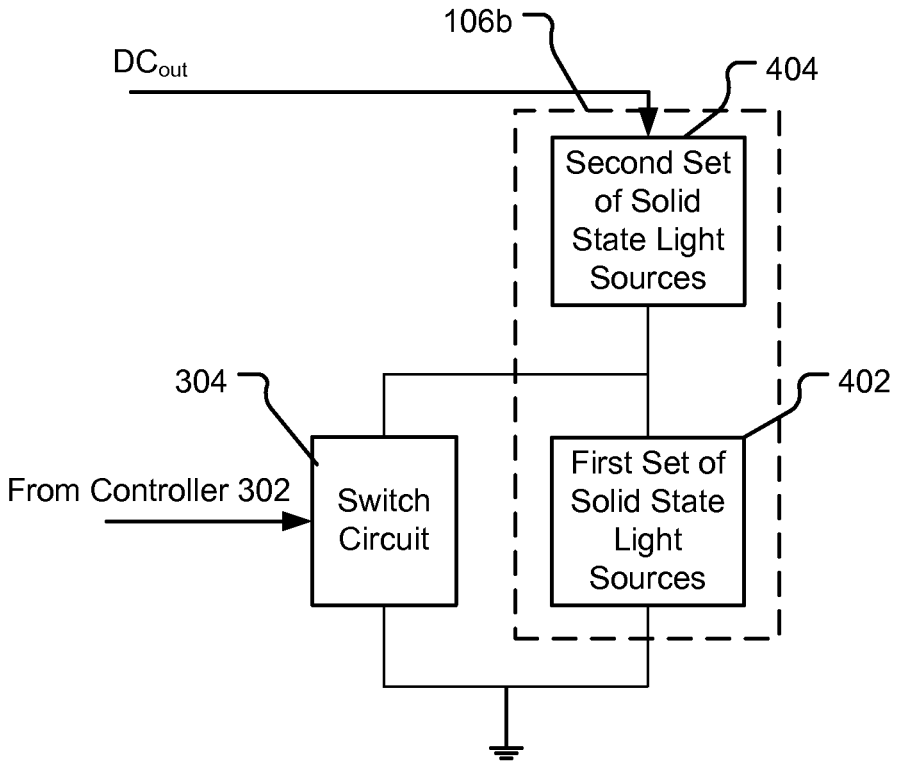
FIG. 5 is another block diagram of a light source including one or more solid state light sources according to embodiments disclosed herein.

FIG. 5 illustrates a light source 106*b* including a first set of solid state light sources 402 and a second set of solid state light sources 404. In FIG. 5, a parallel combination of the switch circuit 304 and the first set of solid state light sources 402 is coupled in series with the second set of solid state light sources 404. In such an arrangement, when the switch circuit 304 is in an open state, current may flow through the first 402 and second 404 sets of solid state light sources, but when the switch circuit 304 (and/or the switch therein) is closed, current may continue to flow through the second set of solid state light sources 404 but may be shunted around the first set of solid state light sources 402 through the switch circuit 304.

With reference also to FIG. 3, the controller circuit 302 is configured to provide an output to the switch circuit 304 in response to the rectified output voltage $AC_{rect}$ and to a voltage reference signal provided by the voltage reference circuit 306. The output of the controller circuit 302 may vary according to a timing established by the variations in the rectified output voltage $AC_{rect}$ to control the switch circuit 304 to control current through the first set of solid state light sources 402. The controller circuit 302 may also provide a control signal to the switching converter circuit 204. The control signal of the controller circuit 302 may vary the drive signal (e.g. the slope or duty cycle of the drive signal) to control the switch in the switching regulator of the switching converter circuit 204 to thereby modify the value of $DC_{out}$ with changes in the open and closed state of the switch circuit 304. Varying the drive signal in this manner may assist in avoiding current surges when closing the switch circuit 304 to cause illumination of the solid state light sources in the first set 402.

Figure 6:
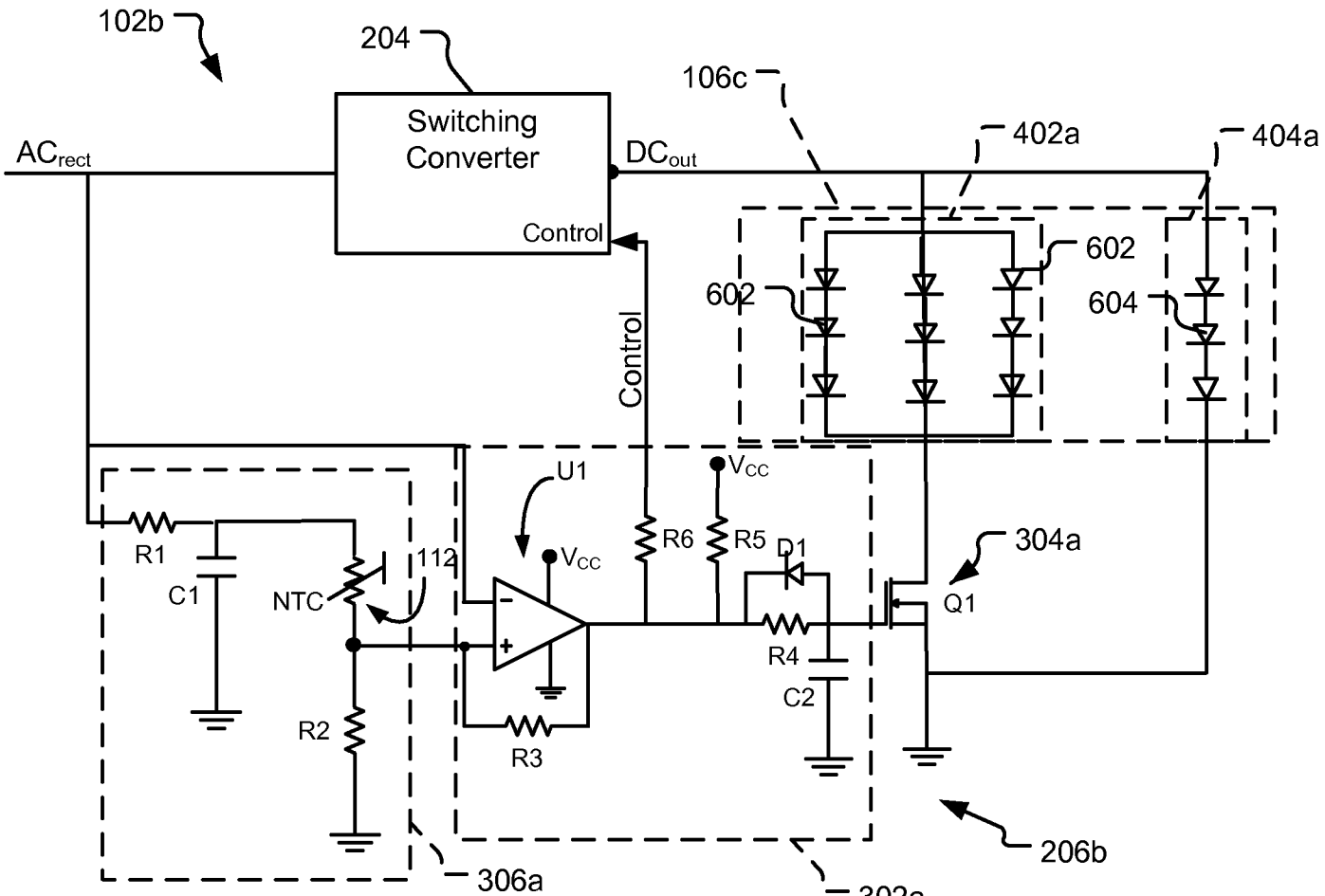
FIG. 6 is a circuit diagram of a driver circuit coupled to a light source according to embodiments disclosed herein.

FIG. 6 is a circuit diagram showing the driver circuit 102*b* of FIG. 3 with the optional synchronous oscillator circuit 308 omitted, i.e. the rectified output voltage $AC_{rect}$ is coupled directly to the controller circuit 302 without use of the optional synchronous oscillator circuit 308. The driver circuit 102*b* includes a switching converter 204, a mixing circuit 206*b*, and a light source including one or more solid state light sources 106*c*. The mixing circuit 206*b* includes a controller circuit 302*a*, a switch circuit 304*a*, and a voltage reference circuit 306*a*. The light source 106*c* includes a first set of solid state light sources 402*a* and a second set of solid state light sources 404*a*. The first set of solid state light sources 402*a* includes a plurality of series combinations of solid state light sources 602 coupled in a parallel combination. In some embodiments, for example, the solid state light sources 602 in the first set 402*a* may all emit a red color of light. The second set of solid state light sources 404*a* includes a series combination of solid state light sources 604. In some embodiments, for example, the solid state light sources 604 in the second set 404*a* may all emit a green color of light.

The switch circuit 304*a* includes a transistor switch Q1 (also referred to hereinafter as "switch Q1") coupled in series with the first set of solid state light sources 402*a*. The transistor switch Q1 is configured as a MOSFET transistor having a drain coupled to the first set of solid state light sources 402*a* and a source coupled to ground. The series combination of the transistor switch Q1 and the first set of solid state light sources 402*a* is coupled in parallel with the second set of solid state light sources 404*a*. When the switch Q1 is in a conducting state and the drive voltages of the first 402 and second 404 sets of solid state light sources are similar, sufficient current from the switching converter circuit 204 may flow through both the first set of solid state light sources 402*a* and the second set of solid state light sources 404*a* to cause the solid state light sources 602, 604 to emit light. When the drive voltage of the first set of solid state light sources 402 is lower than the drive voltage to the second set of solid state light sources 404, current may flow through the first set of solid state light sources 402 when the switch Q1 is closed, but current through the second set of solid state light sources may be insufficient to cause illumination of the solid state light sources 604 therein. When the switch Q1 is in a non-conducting ("open") state, current flows through the second set of solid state light sources 404*a* to cause the solid state light sources 604 therein to emit light, but current flow through the first set of solid state light sources 402*a* is insufficient to cause the solid state light sources 602 therein to emit light, although there may be some leakage current through the switch Q1 when it is in the non-conducing state.

The gate of the switch Q1 is coupled to the output of the control circuit 302*a* so that the output of the control circuit 302*a* controls the conducting state of the switch Q1 and, hence, the on/off state of the solid state light sources 602 within the first set of solid state light sources 402*a*. The control circuit 302*a* includes an operational amplifier U1. The operational amplifier U1 has an inverting input coupled directly to the rectified output voltage $AC_{rect}$, and a non-inverting input coupled to the voltage reference circuit 306*a*. The voltage reference circuit 306*a* is coupled to the rectified output voltage $AC_{rect}$ and includes a resistor R1 and a capacitor C1 for smoothing the rectified output voltage $AC_{rect}$. A voltage divider including a thermistor NTC and a resistor R2 is coupled to the smoothed signal across the capacitor C1. The non-inverting input of the operational amplifier U1 is coupled to the node between the thermistor NTC and the resistor R2. A reference voltage may thus be established at the non-inverting input of the operational amplifier U1 by selection of the values of the thermistor NTC and the resistor R2. As is known, the electrical resistance exhibited by the thermistor NTC varies with temperature. A variety of thermistor configurations, such as but not limited to negative temperature coefficient (NTC) and positive temperature coefficient (PTC) thermistors, are well-known. In alternative embodiments, the voltage reference circuit 306*a* may include a voltage regulator circuit to provide a regulated voltage that is divided by the thermistor NTC and the resistor R2. In such embodiments, the resistor R1 and the capacitor C1 may be omitted and the voltage regulator circuit may provide a regulated DC voltage output in response to the rectified output voltage $AC_{rect}$.

The operational amplifier U1 may be coupled to a DC supply voltage $V_{cc}$, and provide a pulse-width modulated output having a value dependent upon the value of voltage levels at the inverting and non-inverting inputs, i.e. the value of $AC_{rect}$ and the voltage reference provided by the voltage reference circuit 306*a*, respectively. A resistor R3 is coupled from the output of the operational amplifier U1 to the non-inverting input of the operational amplifier U1 to provide hysteresis in the output of the operational amplifier U1. The output of the operational amplifier U1 is coupled to the gate of the switch Q1 through a resistor R4. A capacitor C2 is coupled between the gate of the switch Q1 and ground. The capacitor C2 is configured to charge through the resistor R4 and discharge through a diode D1, and slows down switching of the switch Q1 in response to the output of the operational amplifier U1 to reduce current surge when the solid state light sources 602 of the first set of solid state light sources 402*a* are illuminated by placing the switch Q1 in a closed (i.e., conducting) state. The output of the operational amplifier U1 is also coupled to the supply voltage $V_{cc}$ through a pull up resistor R5 and to a control input of the switching converter circuit 204 through a resistor R6. When the output of the operational amplifier U1 goes "high" to close the switch Q1 and cause illumination of the solid state light sources 602 within the first set of solid state light sources 402*a*, a control signal is provided to the control input through the resistor R6 to vary the drive signal (e.g. the slope or duty cycle of the drive signal) that controls the switch in the switching regulator of the switching converter circuit 204 to thereby modify the switching converter output $DC_{out}$. For example, in embodiments including a switching converter circuit 204 with a model number TPS40050 controller, as described above, the output of the operational amplifier U1 may be coupled to the KFF input of the controller through the resistor R6. Varying the switching converter output $DC_{out}$ in this manner may assist in avoiding current surges when closing the switch Q1 to cause illumination of the solid state light sources 602 in the first set of solid state light sources.

Figure 7:
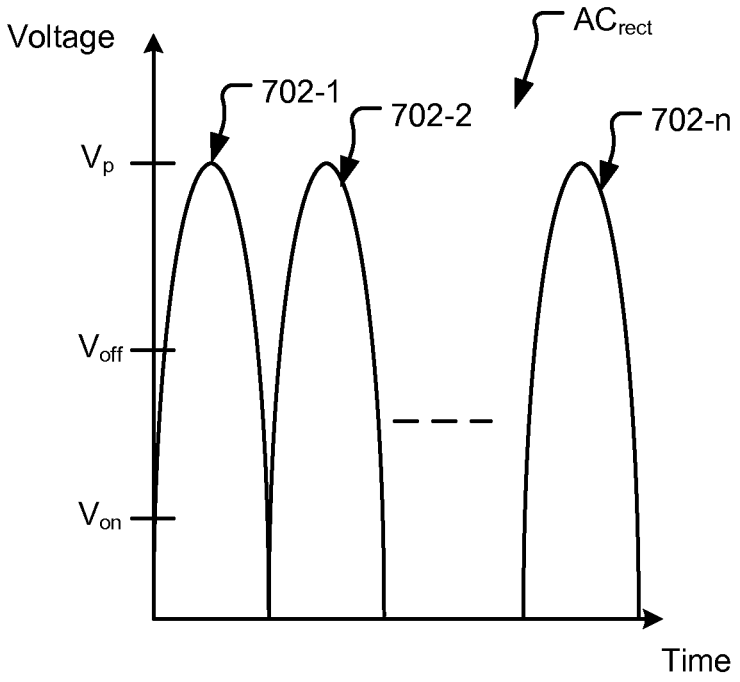
FIG. 7 diagrammatically illustrates a rectified AC signal and the voltage levels at which switching of current through at least one solid state light source occurs according to embodiments disclosed herein.

Advantageously, therefore, the output of the control circuit 302*a* varies the conducting state of the switch Q1 to switch current through the first set of solid state light sources 402*a* according to the timing established by the rectified output voltage $AC_{rect}$. FIG. 7 diagrammatically illustrates the rectified output voltage $AC_{rect}$. As shown, the rectified output voltage $AC_{rect}$ may include a plurality of half-waves 702-1, 702-1..**702-*n*, occurring at a particular frequency (e.g. 120 half-waves/second) and at a particular peak voltage $V_p$. Each time the value of $AC_{rect}$ exceeds a threshold voltage $V_{on}$ set by the voltage reference circuit 306*a* including the thermistor NTC and the resistor R2, the output of the operational amplifier U1 may cause the switch Q1 to enter a conducting state to switch current through the first set of solid state light sources 402*a* to cause the solid state light sources 602 to emit light. Each time the value of $AC_{rect}$ drops from a high level to a second voltage $V_{off}$ set by the hysteresis resistor R3, the output of the operational amplifier U1 may cause the switch Q1 to enter a non-conducing state whereby current through the first set of solid state light sources 402*a* is insufficient to cause the solid state light sources 602 to emit light while current flow through the second set of solid state light sources 404*a* continues to cause the solid state light sources 604** therein to emit light.

In the driver circuit **102*b* of FIG. 6, the value of the second voltage $V_{off}$ may vary according to the resistance value exhibited by the thermistor NTC. This may be advantageous when the output of the solid state light sources 602 in the first set of solid state light sources 402*a* varies with temperature. In such configurations, the thermistor NTC may be physically placed adjacent the solid state light sources 602 of the first set of solid state light sources 402*a* so that the resistance of the thermistor NTC, and hence the voltage reference at the non-inverting input of the operational amplifier U1, varies with the temperature of the solid state light sources 602 in the first set of solid state light sources 402*a*. For example, in embodiments wherein the solid state light sources 602 emit red light, the solid state light sources 602 may require increased current with rising temperature and may dim with rising temperature if the value of $V_{off}$ remains constant. By placing the thermistor NTC adjacent the solid state light sources 602 of the first set of solid state light sources 402*a*, the resistive value of the thermistor NTC may change with rising temperature of the solid state light sources 602 to reduce the second voltage $V_{off}$ to a value lower than the original setting of $V_{off}$. As a result, the solid state light sources 602 of the first set of solid state light sources 402*a*** may emit light for a longer time period with rising temperature to counteract dimming associated with rising temperature.

Figure 8:
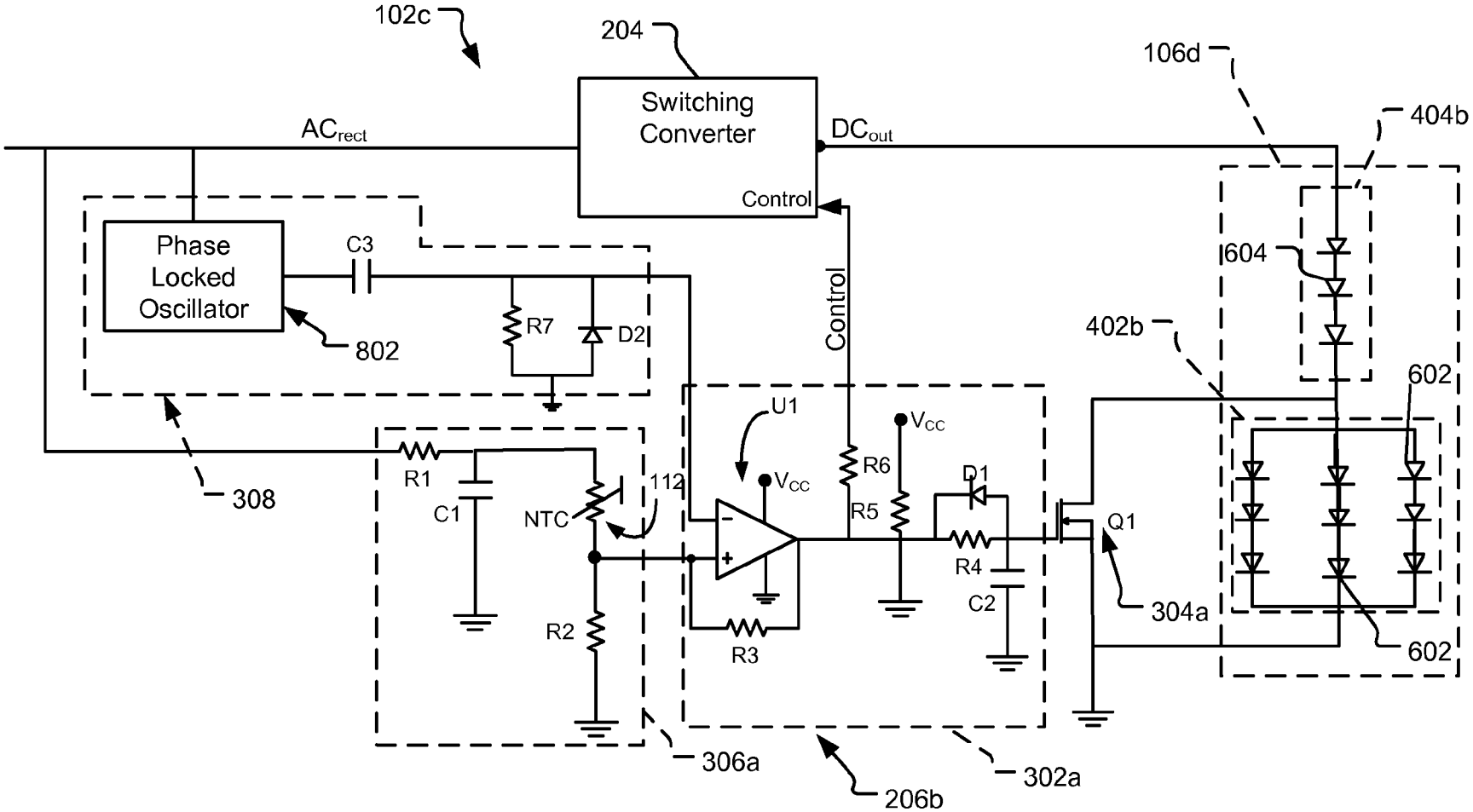
FIG. 8 is another circuit diagram of a driver circuit coupled to a light source according to embodiments disclosed herein.

FIG. 8 is a circuit diagram showing a driver circuit **102*c* that includes the optional synchronous oscillator circuit 308 shown in FIG. 3. The driver circuit 102*c* includes a switching converter 204, a mixing circuit 206*b*, and a light source including one or more solid state light sources 106*d*. The mixing circuit 206*b* includes a controller circuit 302*a*, a switch circuit 304*a*, a voltage reference circuit 306*a*, and the synchronous oscillator circuit 308. Operation of the switching converter 204, the controller circuit 302*a*, the switch circuit 304*a*, and the voltage reference circuit 306*a* is the same as described in connection with FIG. 6 above and, for simplicity, details thereof may be omitted in the description of the driver circuit 102*c* of FIG. 8**.

The light source **106*d* includes a first set of solid state light sources 402*b* and a second set of solid state light sources 404*b*. The first set of solid state light sources 402*b* includes a plurality of series combinations of solid state light sources 602 coupled in a parallel combination. In some embodiments, for example, the solid state light sources 602 in the first set 402*b* may all emit a red or amber color of light. The second set of solid state light sources 404*b* includes a series combination of solid state light sources 604. In some embodiments, the solid state light sources 604 in the second set 404*b* may all emit a green or mint color of light. The switch circuit 304*a* is coupled in parallel with the first set of solid state light sources 402*b*. The parallel combination of the switch Q1 of the switch circuit 304*a* and the first set of solid state light sources 402*b* is coupled in series with the second set of solid state light sources 404*b*. When the switch Q1 is in a non-conducting state, i.e. the switch Q1 is "open", sufficient current from the switching converter circuit 204 flows through both the first set of solid state light sources 402*b* and the second set of solid state light sources 404*b* to cause the solid state light sources 602, 604 to emit light. When the switch Q1 is in a conducting state, i.e. the switch Q1 is closed, current flows through the second set of solid state light sources 404*b* to cause the solid state light sources 604 in the second set of solid state light sources 404*b* to emit light, but current flow through the first set of solid state light sources 402*b* is shunted through the switch Q1, whereby current through the first set of solid state light sources 402*b* is insufficient to cause the solid state light sources 602 in the first set of solid state light sources 402*b* to emit light, although there may be some small current through the first set of solid state light sources 402*b* when the switch Q1** is in its conducing state.

The gate of the switch Q1 is coupled to the output of the control circuit **302*a* so that the output of the control circuit 302*a* controls the conducting state of the switch Q1 and, hence, the on/off state of the solid state light sources 602 within the first set of solid state light sources 402*b*. The control circuit 302*a* includes an operational amplifier U1. The operational amplifier U1 has an inverting input coupled directly to an output of the synchronous oscillator circuit 308, and a non-inverting input coupled to the voltage reference circuit 306*a*. The operational amplifier U1 provides a pulse-width modulated output having a value dependent upon the value of voltage levels at the inverting and non-inverting inputs, i.e. the value of the output of the synchronous oscillator circuit 308 and the voltage reference provided by the voltage reference circuit 306*a*, respectively. As described in connection with FIG. 6, the voltage reference circuit establishes a reference voltage at the non-inverting input of the operational amplifier U1 based on the values of the thermistor NTC and the resistor R2**.

The synchronous oscillator circuit 308 receives the rectified output voltage $AC_{rect}$ and in response thereto provides an output to the inverting input of the operational amplifier U1 that oscillates at the frequency of the half-waves in the rectified output voltage $AC_{rect}$ (e.g. 120 Hz). Embodiments including a synchronous oscillator circuit 308 may be less susceptible to variations in power supply characteristics compared to embodiments wherein the rectified output voltage $AC_{rect}$ is coupled directly to the controller circuit **302*a***.

In FIG. 8, the synchronous oscillator circuit 308 includes a known phase locked oscillator 802, a capacitor C3, a resistor R7, and a diode D2. The phase locked oscillator 802 receives the rectified output voltage $AC_{rect}$ as an input and in response thereto, provides an oscillating output, e.g. a square wave, at the frequency of the half-waves in the rectified output voltage $AC_{rect}$. A variety of possible oscillator configurations useful as the phase locked oscillator 802 are well-known to those of ordinary skill in the art. In some embodiments, for example, the phase locked oscillator 802 may be a 74HC4046 oscillator commercially available, for example, from Fairchild Semiconductor of San Jose, Calif., USA. The output of the phase locked oscillator 802 is coupled to the inverting input of the operational amplifier U1 through the capacitor C3. The resistor R7 and the diode D2 are coupled in parallel between the inverting input of the operational amplifier U1 and ground. The output of the phase locked oscillator 802 charges the capacitor C3, which discharges through the resistor R7 to establish a triangle wave output for the synchronous oscillator circuit 308 at the frequency of the half-waves in the rectified output voltage $AC_{rect}$. For each cycle of the triangular wave output of the synchronous oscillator circuit 308, a portion of the triangular wave has a voltage level higher than the reference voltage established by the voltage reference circuit 306*a* at the non-inverting input of the operational amplifier U1. During a time period of each cycle of the triangular wave output of the synchronous oscillator circuit 308 when the triangular wave output is higher than the voltage reference at the output of the voltage reference circuit 306*a*, the operational amplifier U1 places the switch circuit 304*a* in an open state, whereby current flows through the solid state light sources 602, 604 of both the first set of solid state light sources 402*b* and the second set of solid state light sources 404*b*. During a time period of each cycle of the triangular wave output of the synchronous oscillator circuit 308 when the triangular wave output is lower than the voltage reference at the output of the voltage reference circuit 306*a*, the operational amplifier U1 places the switch circuit 304*a* in closed state, whereby current flows through the solid state light sources 604 of the second set of solid state light sources 404*b*, but is shunted around the solid state light sources 602 of the first set of solid state light sources 402*b* through the switch circuit 304*a* (though, as noted above, some small current may flow through the first set of solid state light sources 402*b* associated with a drain-to-source voltage of the switch Q1).

Figure 9:
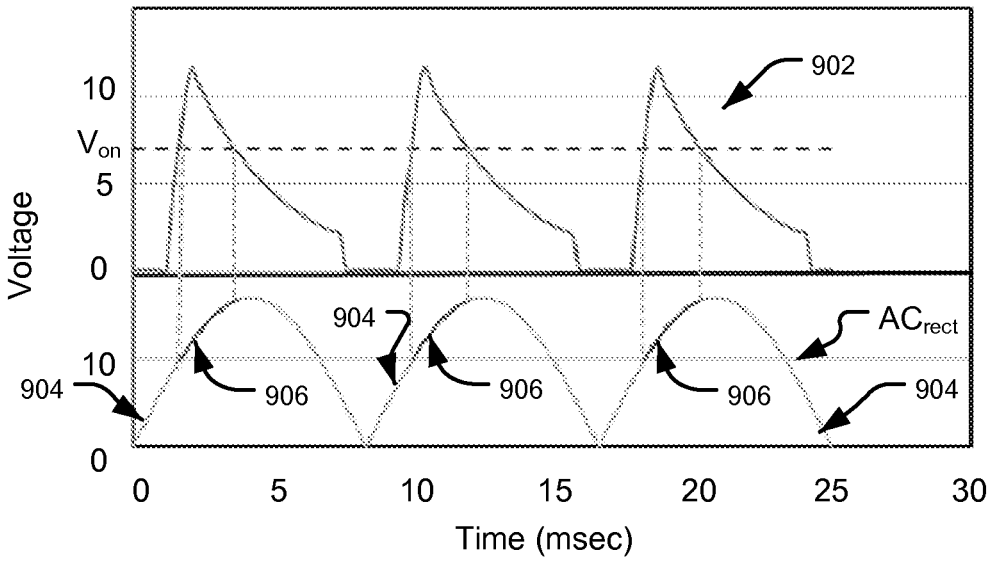
FIG. 9 diagrammatically illustrates a rectified AC signal and an output of a synchronous oscillator showing the voltage level at which switching of current through at least one solid state light source occurs according to embodiments disclosed herein.

FIG. 9, for example, diagrammatically illustrates the rectified output voltage $AC_{rect}$, which is provided as an input to the synchronous oscillator circuit 308 of FIG. 8, and the corresponding square-wave output 902 of the synchronous oscillator circuit 308 of FIG. 8, which is provided to the non-inverting input of the operational amplifier U1 of FIG. 8. As shown, the rectified output voltage $AC_{rect}$ may include a plurality of half-waves 904, occurring at a particular frequency (e.g. 120 half-waves/second) and at a particular peak voltage, e.g. about 12V in FIG. 9. Each time the voltage level of the square-wave output 902 exceeds the threshold voltage $V_{on}$ set by the voltage reference circuit 306*a*, i.e. in the portion 906 of each of the half-waves of the rectified output voltage $AC_{rect}$ indicated by dashed lines in FIG. 9, the output of the operational amplifier U1 may cause the switch Q1 to enter a non-conducing state to allow current flow through both the first 402*b* and second 404*b* sets of solid state light sources. When the voltage level of the square-wave output 902 is below the threshold voltage $V_{on}$ set by the voltage reference circuit 306*a*, the output of the operational amplifier U1 may cause the switch Q1 to enter a conducing state, whereby current through the first set of solid state light sources 402*b* is insufficient to cause the solid state light sources 602 to emit light, while current flow through the second set of solid state light sources 404*b* continues to cause the solid state light sources 604 to emit light.

Figure 10:
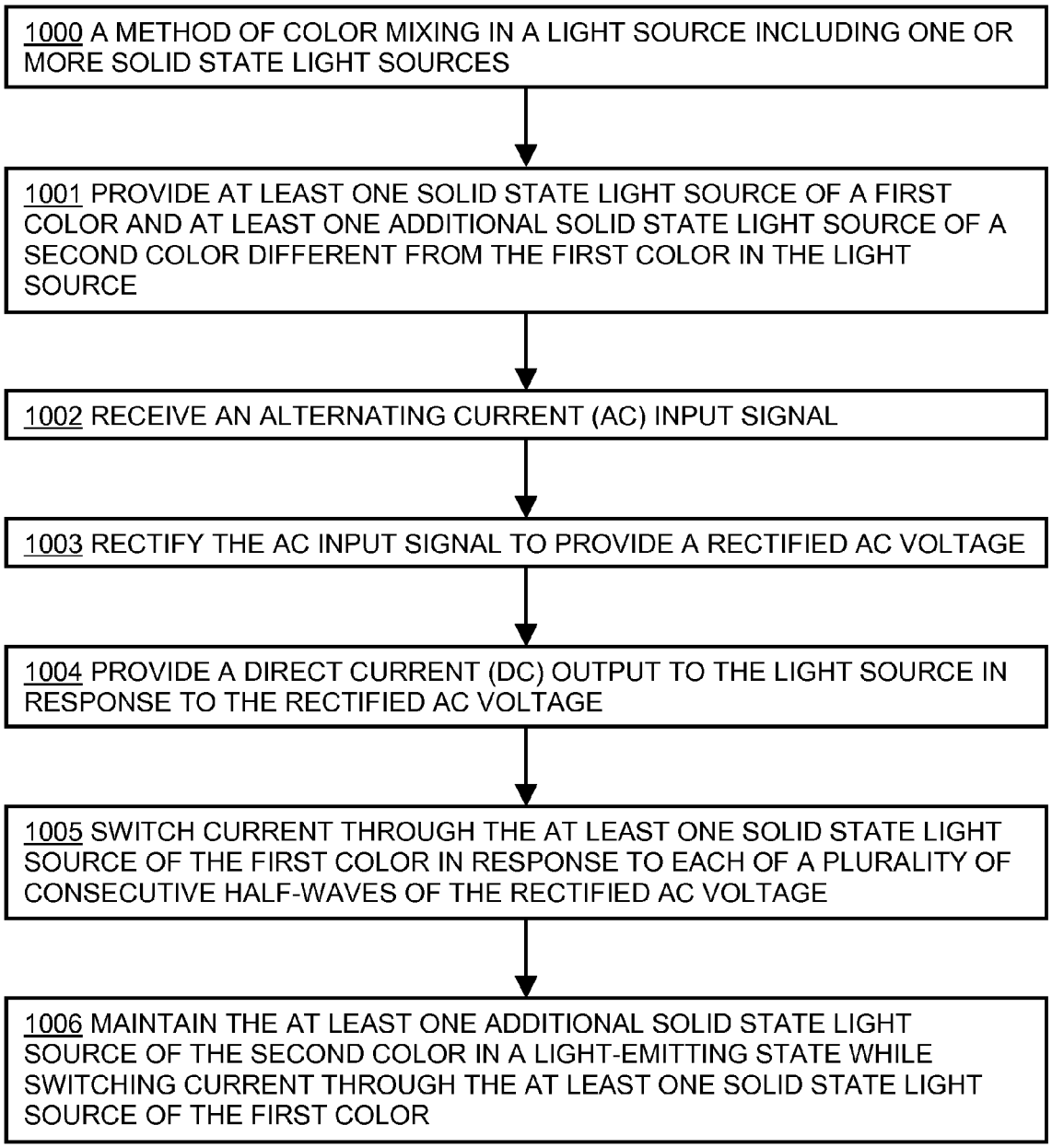
FIG. 10 is a block flow diagram of a method of driving solid state light sources so as to color mix their outputs according to embodiments disclosed herein.

FIG. 10 is a block flow diagram of a method 1000 of color mixing in a light source including one or more solid state light sources. The illustrated block flow diagram may be shown and described as including a particular sequence of steps. It is to be understood, however, that the sequence of steps merely provides an example of how the general functionality described herein can be implemented. The steps do not have to be executed in the order presented unless otherwise indicated.

In the method 1000, at least one solid state light source of a first color and at least one additional solid state light source of a second color different from the first color in the light source are provided, step 1001. An alternating current (AC) input signal is received, step 1002. The AC input signal is rectified, step 1003, to provide a rectified AC voltage. A direct current (DC) output is provided to the light source in response to the rectified AC voltage, step 1004. The current through the at least one solid state light source of the first color is switched in response to each of a plurality of consecutive half-waves of the rectified AC voltage, step 1005. In some embodiments, the at least one additional solid state light source of the second color is maintained in a light-emitting state while switching current through the at least one solid state light source of the first color, step 1006.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

As used throughout, a "circuit" or "circuitry" may comprise, for example, singly or in any combination, hardwired circuitry, programmable circuitry, state machine circuitry, and/or firmware that stores instructions executed by programmable circuitry.

The term "coupled" as used throughout refers to any connection, coupling, link or the like, by which signals carried by one system element are imparted to the "coupled" element. Such "coupled" devices, or signals and devices, are not necessarily directly connected to one another and may be separated by intermediate components and/or devices that may manipulate or modify such signals. Likewise, the terms "connected" or "coupled" as used throughout in regard to mechanical or physical connections or couplings is a relative term and does not require a direct physical connection. Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A driver circuit comprising:

a rectifier circuit configured to receive an alternating current (AC) input voltage and to provide a rectified AC voltage;

a switching converter circuit coupled to a light source including one or more solid state light sources, the switching converter circuit configured to provide a direct current (DC) output to the light source in response to the rectified AC voltage; and a mixing circuit coupled to the light source to switch current through at least one solid state light source of the light source in response to each of a plurality of consecutive half-waves of the rectified AC voltage, wherein the mixing circuit comprises:

a switch circuit having a conductive state, wherein the switch circuit is coupled to the at least one solid state light source;

a controller circuit configured to provide a controller output to change the conductive state of the switch circuit in response to each of the plurality of half-waves of the rectified AC voltage; and a voltage reference circuit configured to establish a reference voltage;

wherein the controller circuit is configured to provide the controller output in response to the reference voltage and the rectified AC voltage;

wherein the mixing circuit further comprises a synchronous oscillator circuit configured to provide an output at a frequency of the plurality of half-waves of the rectified AC voltage; and wherein the controller circuit comprises an operational amplifier having an output coupled to the switch circuit, a first input of the operational amplifier coupled to the output of the synchronous oscillator circuit, and a second input of the operational amplifier coupled to the reference voltage.

2. The driver circuit of claim 1, wherein the voltage reference circuit comprises a voltage divider comprising a thermistor that exhibits a resistance that varies with a temperature of the at least one solid state light source.

3. The driver circuit of claim 1, wherein the controller circuit comprises an operational amplifier having an output coupled to the switch circuit, wherein a first input of the operational amplifier is coupled to the rectified AC voltage and a second input of the operational amplifier is coupled to the reference voltage.

4. The driver circuit of claim 1, wherein the switching converter circuit includes a control input and wherein the controller circuit is configured to provide a control output to the control input of the switching converter circuit, the control output to modify the DC output when the current is switched through the at least one solid state light source.

5. The driver circuit of claim 1, wherein the light source comprises at least one additional solid state light source configured to remain in a light-emitting state while the mixing circuit switches current through the at least one solid state light source.

6. The driver circuit of claim 5, wherein the light source comprises a first set of solid state light sources and a second set of solid state light sources, wherein the first set of solid state light sources comprises the at least one solid state light source, and wherein the second set of solid state light sources comprises the at least one additional solid state light source, the second set of solid state light sources being coupled in parallel with a series combination of the first set of solid state light sources and the switch circuit.

7. The driver circuit of claim 5, wherein the light source comprises a first set of solid state light sources and a second set of solid state light sources, wherein the first set of solid state light sources comprises the at least one solid state light source, and wherein the second set of solid state light sources comprises the at least one additional solid state light source, the second set of solid state light sources being coupled in series with a parallel combination of the first set of solid state light sources and the switch circuit.

8. A luminaire, comprising:

a housing;

a light source including one or more solid state light sources disposed within the housing; and a driver circuit disposed within the housing, the driver circuit comprising:

a rectifier circuit configured to receive an alternating current (AC) input voltage and to provide a rectified AC voltage;

a switching converter circuit coupled to the light source including one or more solid state light sources, the switching converter circuit configured to provide a direct current (DC) output to the light source in response to the rectified AC voltage; and a mixing circuit coupled to the light source to switch current through at least one solid state light source of the light source in response to each of a plurality of consecutive half-waves of the rectified AC voltage, wherein the mixing circuit comprises:

a switch circuit having a conductive state, wherein the switch circuit is coupled to the at least one solid state light source;

a controller circuit configured to provide a controller output to change the conductive state of the switch circuit in response to each of the plurality of half-waves of the rectified AC voltage; and a voltage reference circuit configured to establish a reference voltage;

wherein the controller circuit is configured to provide the controller output in response to the reference voltage and the rectified AC voltage;

wherein the mixing circuit comprises a synchronous oscillator circuit configured to provide an output at a frequency of the plurality of half-waves of the rectified AC voltage: and wherein the controller circuit comprises an operational amplifier having an output coupled to the switch circuit, a first input of the operational amplifier coupled to the output of the synchronous oscillator circuit, and a second input of the operational amplifier coupled to the reference voltage.

9. The luminaire of claim 8, wherein the controller circuit comprises an operational amplifier having an output coupled to the switch circuit, wherein a first input of the operational amplifier is coupled to the rectified AC voltage and a second input of the operational amplifier is coupled to the reference voltage.

10. The luminaire of claim 8, wherein the light source comprises at least one additional solid state light source configured to remain in a light-emitting state while the mixing circuit switches current through the at least one solid state light source.

11. The luminaire of claim 10, wherein the light source comprises a first set of solid state light sources and a second set of solid state light sources, wherein the first set of solid state light sources comprises the at least one solid state light source, and wherein the second set of solid state light sources comprises the at least one additional solid state light source, the second set of solid state light sources being coupled in parallel with a series combination of the first set of solid state light sources and the switch circuit.

12. The luminaire of claim 10, wherein the light source comprises a first set of solid state light sources and a second set of solid state light sources, wherein the first set of solid state light sources comprises the at least one solid state light source, and wherein the second set of solid state light sources comprises the at least one additional solid state light source, the second set of solid state light sources being coupled in series with a parallel combination of the first set of solid state light sources and the switch circuit.

* * * * *